US005591080A

United States Patent [19]

Ward

[11] Patent Number: 5,591,080

[45] Date of Patent: Jan. 7, 1997

[54] EXHAUST VENT COVER

[75] Inventor: John F. Ward, Midhurst, Canada

[73] Assignee: Canplas Industries Ltd., Barrie, Canada

[21] Appl. No.: 276,582

[22] Filed: Jul. 18, 1994

[51] Int. Cl.[6] ..... F24F 7/02

[52] U.S. Cl. ..... 454/359; 454/366

[58] Field of Search ..... 52/199; 454/359, 454/363, 366, 367

[56] References Cited

U.S. PATENT DOCUMENTS

| | | | |
|---|---|---|---|
| 2,692,548 | 10/1954 | Knorr | 454/366 |
| 2,741,972 | 4/1956 | Pryne | 454/363 X |
| 3,250,206 | 5/1966 | Strouth | 454/359 |
| 4,151,789 | 5/1979 | Grobard | 454/359 |
| 4,297,814 | 11/1981 | Tomassetti, Jr. et al. | 52/81.4 |
| 5,344,363 | 9/1994 | Pollock | 454/359 X |

FOREIGN PATENT DOCUMENTS

| | | | |
|---|---|---|---|
| 467801 | 9/1950 | Canada | 454/366 |
| 55538 | 3/1986 | Japan | 454/367 |

*Primary Examiner*—Harold Joyce

[57] ABSTRACT

An exhaust vent cover for closing the exhaust vent when the exhaust vent is not in use is shown. The exhaust vent cover includes a peripheral flange for attaching the cover to a surface and a continuous hollow body extending upwardly from the flange and having an open front as well as an air passageway communicating with this open front. The continuous hollow body further includes an overhang extending beyond the open front, a grill covering the open front to prevent access to the inside of the continuous hollow body, and a valve located inside the hollow body across the air passageway. The exhaust vent cover also includes a sloped upper surface to prevent the valve from being blown open.

14 Claims, 5 Drawing Sheets

EXHAUST VENT COVER

FIELD OF THE INVENTION

This invention relates to a cover, and in particular to a cover of the type used for covering bathroom or kitchen exhaust pipes which extend through roofs and the like.

BACKGROUND OF THE INVENTION

In residential construction, there is often the need to provide an exhaust vent from a room, particularly a kitchen or a bathroom, directly to the outside. Such exhaust vents typically comprise vertical pipes or conduits which have at their lower end a fan. Upon activation the fan causes air to be exhausted from the room through the conduit to the outside.

In the past, it has been common to provide a vent cover which includes a one-way valve at the exit end of the conduit. Upon the vent being activated, the pressure increases in the conduit and the one-way valve opens to allow the air to exit from the conduit. Typically, such vent covers are formed from metal and the opening and closing of the vent cover is associated with a tinny clanking noise. Under the influence of wind or the like, the valve may be caused to open causing a clanking noise which is carried down the pipe, and through the vent into the living space. For bathrooms associated with bedrooms, this clanking noise can be a source of irritation to anyone trying to sleep. In extreme climates, unwanted opening of the valve can also allow cold or hot air to enter the conduit and can affect the comfortable temperature inside the building. Additionally, the prior designs are susceptible to rain or the like leaking in through the exhaust cover and down the conduit.

SUMMARY OF THE INVENTION

What is desired therefore is an exhaust vent cover which is capable of preventing snow or rain from entering into the conduit and which remains in a closed position when not in use. Such a design would prevent cold or hot air from penetrating the conduit and would also be quiet in that there would be no clanking sound transmitted down the conduit when the valve opens or closes.

Therefore, going to the present invention there is provided:

An exhaust vent cover comprising:

a peripheral flange for attaching the cover to a surface;

a hollow body extending upwardly from the flange and having an air passageway communicating with an open front, said body including an overhang extending beyond said open front; and a replaceable grill covering said open front, said grill including a plurality of water inhibiting fins, which inhibit water from entering the open front.

BRIEF DESCRIPTION OF THE DRAWINGS

Preferred embodiments of the invention will now be described with reference to the attached drawings, which by way of example only, illustrate certain preferred configurations.

DETAILED DESCRIPTION OF THE PREFERRED EMBODIMENTS

Figure 1:
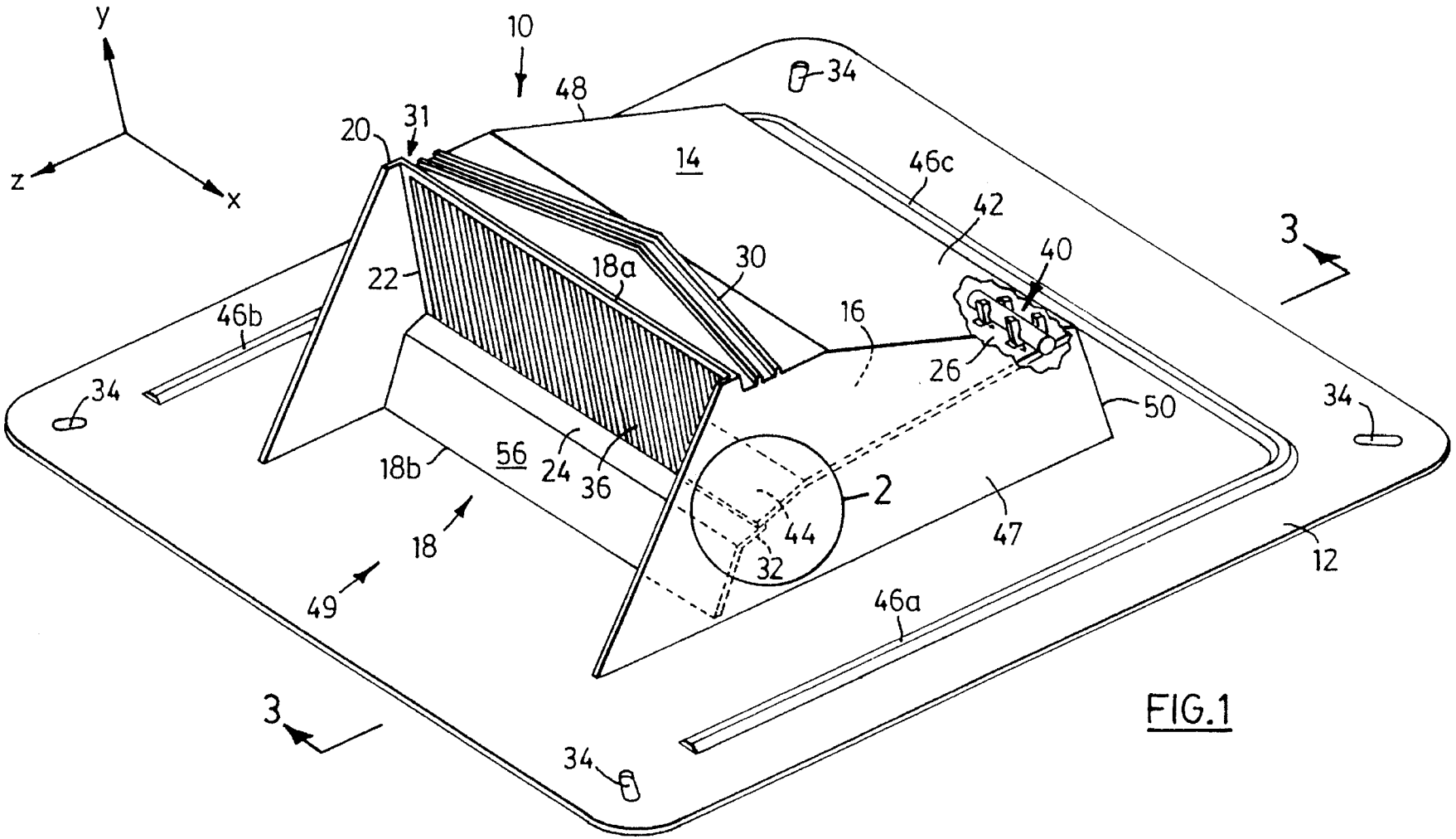
FIG. 1 is a perspective view from above and to one front of one embodiment of the present invention.
Figure 3:
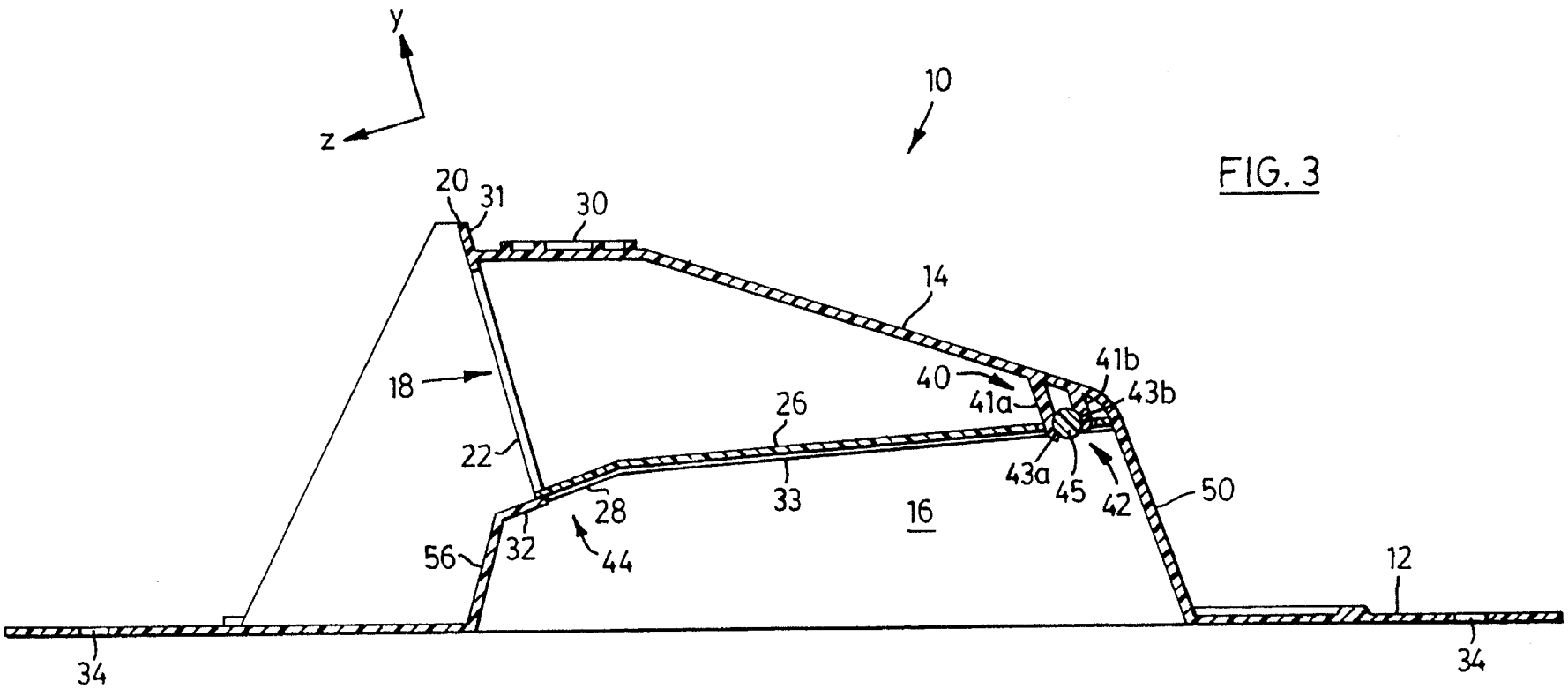
FIG. 3 is a side view of the invention of FIG. 1.

According to the present invention there is provided an exhaust vent cover shown as 10 in FIGS. 1 and 3. This exhaust vent cover 10 is preferably formed from plastic. Preferably, the exhaust vent cover 10 is injection molded from talc filled polypropylene having a thickness of between 75 to 90 thousanths of an inch as an average. It will be appreciated that other plastics and thicknesses may also be used, provided that such other plastics have suitable colour fastness, strength and wearability for outdoor use.

The exhaust vent cover 10 includes a peripheral flange 12 surrounding the base of a hollow body 14. The peripheral flange 12 includes means for attaching the cover 10 to a surface, such as a roof or wall. One form of acceptable means for attaching the cover 10 to a surface is a plurality of attachment openings 34 in the peripheral flange 12 through which nails or the like may pass to secure the peripheral flange 12 and the cover 10 to the surface. Preferably, each of these attachment openings 34 is in the form of a slot, the slot having a longer axis and a shorter axis. In such case, the longer axis is oriented towards the centre of the continuous hollow body 14 to allow the continuous hollow body 14 to expand and contract due to, for example, changes in temperature, without compromising the secure attachment to the surface.

The exhaust vent cover 10 also has a front 49, a back 50, a left side 47 and a right side 48. The terms front, back, left and right are used as above throughout the description to describe the positions of the elements of the present invention relative to one another.

The hollow body 14 has an air passageway 16 which communicates with an open front 18 of the body 14. The open front 18 has a top **18*a* and a base 18*b*. An overhang 20 extends beyond the top 18*a* of the open front 18. The outer surface of the hollow body 14 may include a means for directing water away from the open front 18. Two possible such means are shown on FIGS. 1 and 2 as a projecting lip 31 and a water directing rib 30, both located above the overhang 20**.

The peripheral flange 12 has a three-part ridge 46 having a left part **46*a*, a right part 46*b*, and a back part 46*c*. The left part 46*a* runs between the side 47 and the left edge of flange 12. The right part 46*b* runs between the side 48 and the right edge of flange 12, and the back part 46*c* runs between the back 50 and the back edge of flange 12. The purpose of the ridge 46** is to provide a sealing edge, against which roofing shingles may be pressed. In this manner, water, such as rain or melting snow which contacts the body, and runs down onto the back or sides of the flange will be prevented from moving laterally under the shingles, thereby preventing a leak in the roof.

A valve is positioned within the continuous hollow body 14 and across the air passageway 16. The valve opens and closes the air passageway 16. The valve is preferably in the form of a flapper valve 26 with a pivoting end 42 and a free end 44. The pivoting end 42 is mounted on a pivoting attachment on the inside of the body 14 and the free end 44 rests on a stop 32 when the flapper valve 26 closes the air passageway 16. Preferably, the flapper valve 26 is made from molded plastic and snaps into pivoting engagement with the continuous hollow body 14. One form of pivoting engagement that is acceptable is a hinge 40.

As shown, the hinge 40 is comprised of opposed bearing posts 41*a* and 41*b*, which include opposed part circular portions 43*a* and 43*b*. Because of the inherent resiliency of the posts 41*a* and 41*b*, they can be pressed apart and a pivot bar or axle 45 formed on the flapper valve 26 can be snap fitted into place.

The flapper valve 26 is opened and closed by changes in the relative air pressure of the open front 18 and the exhaust vent. When the air pressure within the exhaust vent is greater than the air pressure of the open front 18, the flapper valve 26 opens, permitting communication of the exhaust vent with the open front 18. When the air pressure of the open front 18 exceeds the air pressure within the exhaust vent, the free end 44 of the flapper valve 26 is forced onto the stop 32 and the air passageway 16 is closed. To ensure that the air passageway 16 is closed when the flapper valve 26 is forced onto the stop 32, a valve seat 33 may be provided. When the flapper valve 26 closes, an upper surface of the valve seat 33 matches a lower surface of the sides of the flapper valve 26 so as to prevent openings through which air may blow.

One problem that commonly arises with exhaust vent covers is that the vent covers are prone to open and close due to the influence of wind. The present invention overcomes this through means for preventing the flapper valve 26 from being blown open. One form this means may take is that the flapper valve 26 has an air deflection surface which, when exposed to wind blowing through the open front 18, deflects the wind upwards, causing the flapper valve 26 to be forced down onto the valve seat and the stop 32. This air deflection surface may be formed by the end of the flapper valve 26 being sloped. For example, the end of the flapper valve 26 nearest the open front 18 can be lower than the other end of the flapper valve 26 to form the deflection surface which forces air blowing through the open front 18 upwards.

Three orthogonal directions may be defined with respect to the open front 18. A first direction, X, extends laterally across the open front 18 between sides 47 and 48, and is substantially parallel to the base 18*b* of the open front 18. A second direction, Y, extends between the top 18*a* and the bottom 18*b* of the open front 18. A third direction, Z, is orthogonal to the first direction X and the second direction Y and is normal to the open front 18.

A grill 22 preferably covers the open front 18 to prevent access by small animals or foreign objects such as leaves to the interior of the hollow body 14. The grill 22 may be formed by a plurality of ribs 36, and the stop 32 may include a lip below the grill 22 formed by the vertical ribs 36. The longitudinal axis of each of the ribs 36 is parallel to the second direction. In this embodiment, the free end 44 of the flapper valve 26 has at least one tooth 38 that fits between the ribs 36 of the grill 22 and that rests on the stop 32 when the flapper valve 26 closes the air passageway 16.

Figure 2:
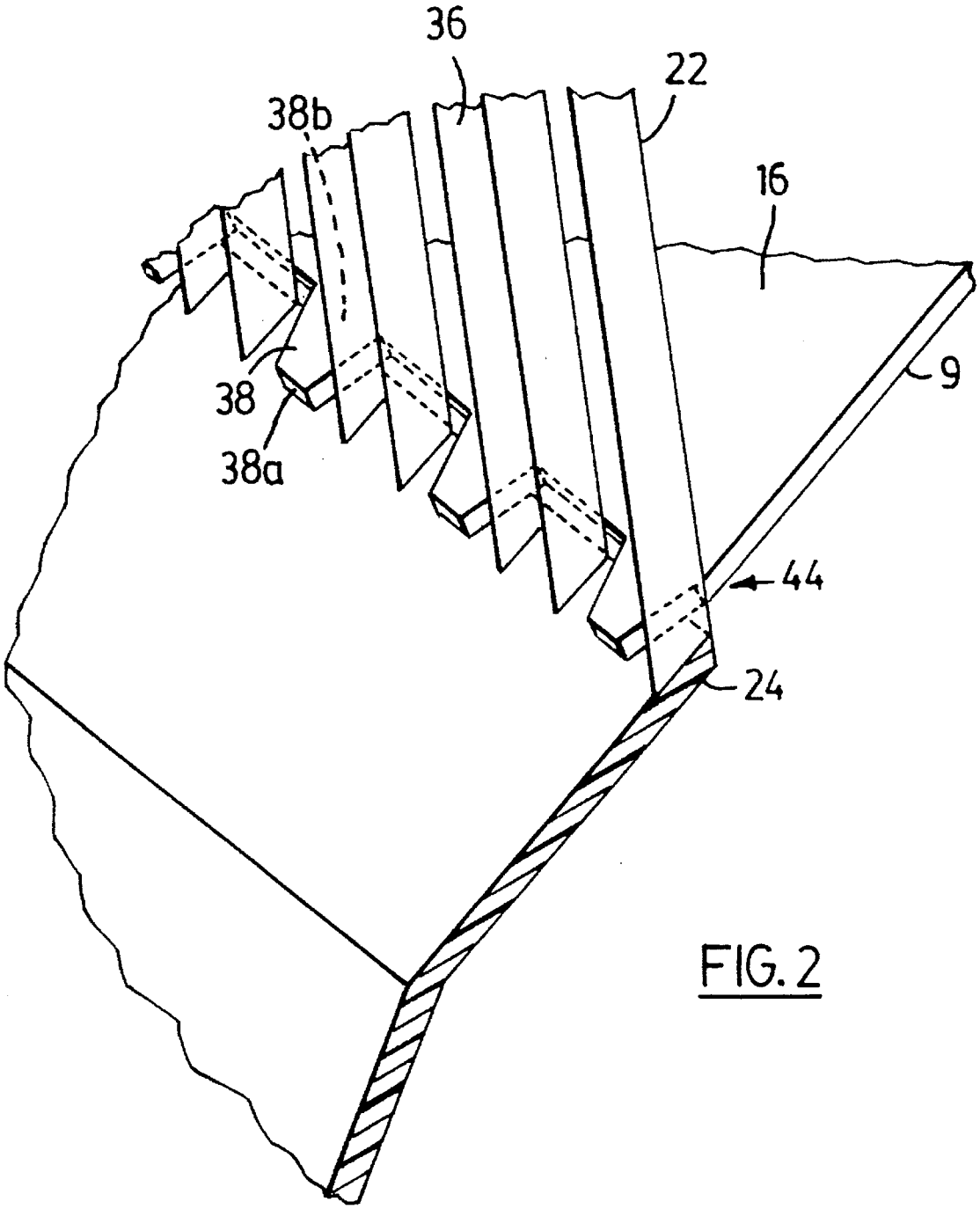
FIG. 2 is an enlarged view of a portion of FIG. 1.

FIG. 2 shows an enlarged view of a portion of FIG. 1 containing the free end 44 of the flapper valve 26, a part of the grill 22 and the plurality of ribs 36, as well as one of the at least one tooth 38 fitting between two of the plurality of ribs 36. Each of the at least one tooth 38 has a base 38*b* connecting it to the rest of the flapper valve 26 and a crown 38*a* opposite to the base 38*b*. The cross-sectional area of the crown 38*a* is narrower than the cross-sectional area of the base 38*b*, as the sides of the tooth 38 taper from the base 38*b* to the crown 38*a*. This tapering ensures that when the flapper valve 26 is lowered the crown 38*a* fits easily between the vertical ribs 36 of the grill 22, but when the flapper valve 26 is entirely shut, the base 38*b* fits relatively tightly between the vertical ribs 36 in order to prevent unwanted air leakage.

The sides 47 and 48 of the hollow body 14 extend substantially beyond the open front 18. This further shields the grill 22 from the elements. Below the grill 22 and the open front 18, the continuous hollow body 14 has a front wall 56, which is slanted such that its lower end is in front of its upper end. This facilitates shedding water down away from the grill 22, when the vent is installed, for example, on a sloped roof.

Figure 4:
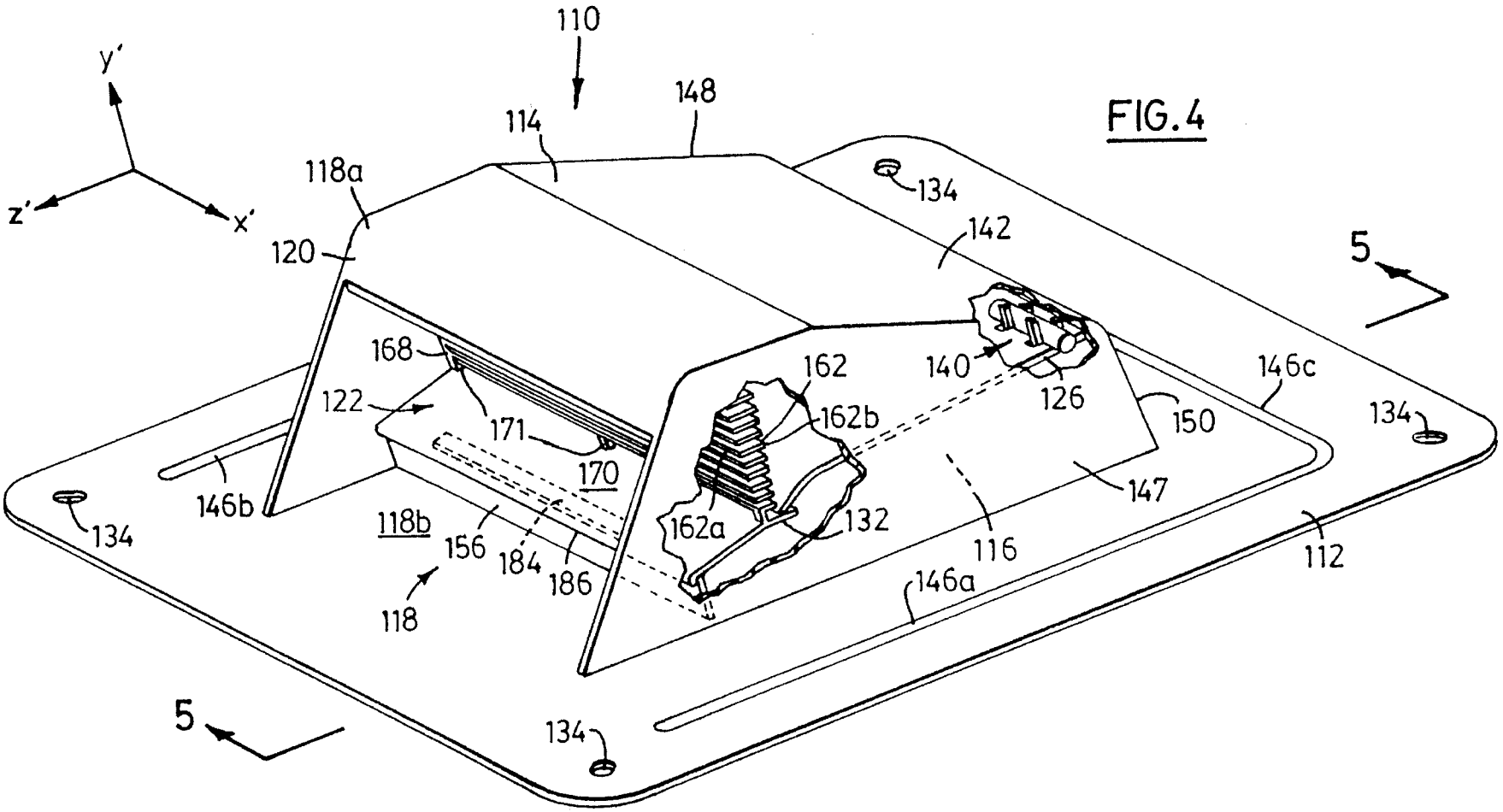
FIG. 4 is a perspective view from above and to the front of a second embodiment of the present invention; and, FIG. 5 is a side view of the invention of FIG. 4.
Figure 5:
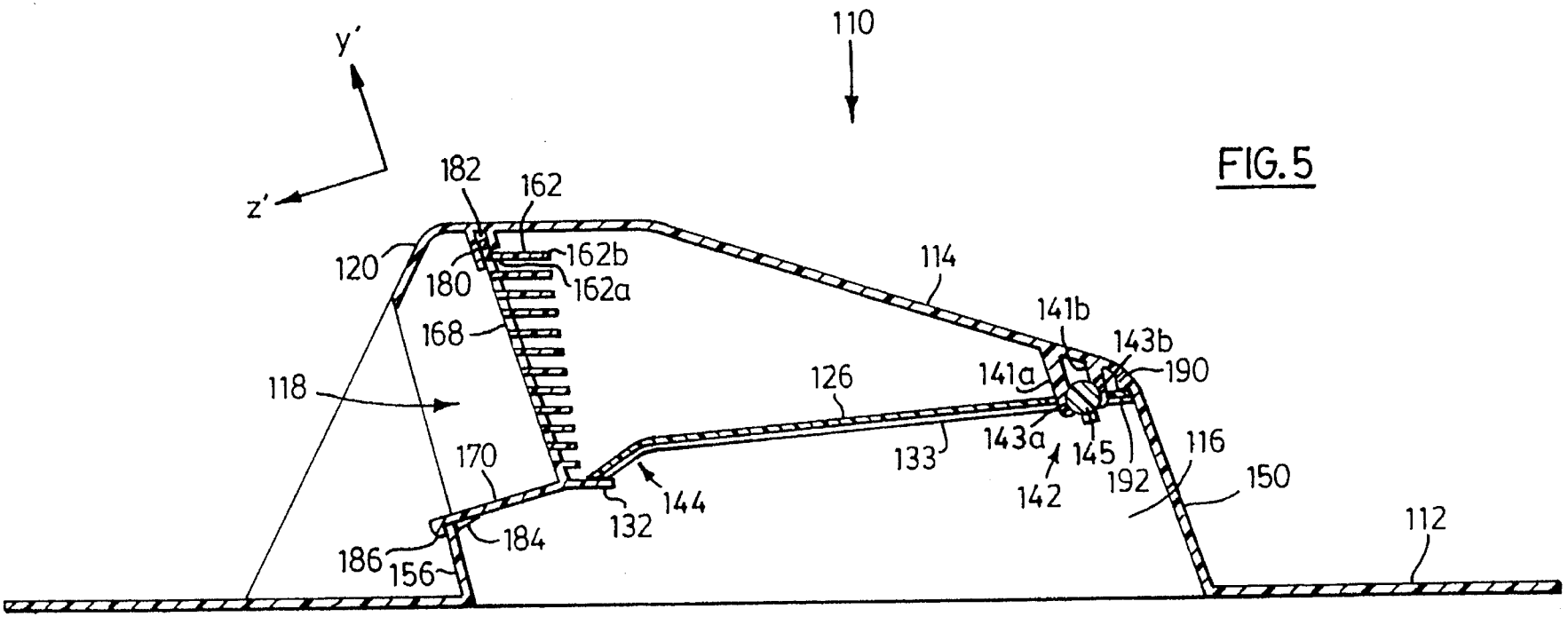

FIGS. 4 and 5 show an exhaust vent cover 110 according to a second embodiment of the present invention. Similar to the first embodiment, the exhaust vent cover 110 includes a peripheral flange 112 surrounding the base of a continuous hollow body 114, and the exhaust vent cover 110 may be integrally formed from plastic. The cover 110 has a front 149, a back 150, a left side 147 and a right side 148 and the terms front, back, left and right are used as above throughout the description of the second embodiment to describe the positions of elements of the present invention relative to one another.

As with the first embodiment, three orthogonal directions may be specified with respect to an open front 118. A first direction, X', extends laterally across the front 118 between a left side 147 and a right 148, and is substantially parallel to a base 118*b* of the open front 118. A second direction, Y', extends between a top 118*a* and the bottom 118*b* of the open front 118. A third direction, Z', is normal to the open front 118.

As shown on the diagram and except where specified below, the elements of the second embodiment of the present invention shown by FIG. 4 correspond to those shown by the first embodiment and are indicated by the same number except that each of the numbers for the elements of the second embodiment are preceded by a one.

The open front 118 of the second embodiment is covered by a plurality of planar fins 162, each planar fin 162 having an front edge 162*a* and a back edge 162*b*. The second direction, Y', is substantially normal to the planes defined by the surfaces of the planar fins 162. This alignment of the planar fins 162 prevents water droplets from entering the open front 118 unless the water droplets are moving in a direction substantially orthogonal to the second dimension Y'. In addition, the sides 147 and 148 extend beyond the open front 118, preventing water moving substantially in the first direction X', from impinging on the open front 118.

In order to penetrate the grill 122, water droplets must be moving substantially parallel to the third direction Z' such that the water droplets are moving from the front of the body 114 to the back of the body 114. However, as the cover 110 is usually installed on a sloping roof such that the front edge 162*a* is lower than the back edge 162*b* for the same fin 162, the motion of the water droplets would have to include an upwards component, against gravity, in order for the droplets to penetrate the grill. Water droplets hitting the surface of the fins 162 will run down the surface of the fins 162 to the front edge 162*b* and will fall off the surface of the fins 162 outside of the hollow body 114.

Preferably, the fins 162 are part of a front piece 168, which is formed from molded plastic separately from the exhaust vent cover 110, and is fitted into place in the exhaust vent cover 110. In this embodiment, the front piece 168 further comprises a base portion 170 extending forward from the base of the fins 162. Due to the presence of the front piece 168, including the fins 162 and the base portion 170, the second embodiment lacks the ribs 36 and the at least one tooth 38 present in the first embodiment. The front piece 168 does include at least three structural ribs 171, which help keep the fins 162 in place. It will be noted that the fins 162 are wider (i.e. extend deeper into the body in the 2' direction) at the top than at the bottom. This is to allow for the free swing of the flapper valve through an arc, without interference from the fins 64. Also, in lab tests, this configuration of fins prevented any significant amount of water from penetrating the vent. Water directed at the vent has a tendency to impact upon the base 170, and deflect or splash upwards. Because the fins extend into the body, and because of the angle of incidence of the water on the base there are effectively no open gaps between adjacent fins 162 for such deflected water to penetrate the body. Thus any water splashing up will strike a fin 162, attach to the fin by surface tension, and eventually drain off the front. Thus effectively almost no water can get in.

When installed on a conventional roof slope (22 ½°) it has been found that the fins as configured in FIG. 5 prevent water from entering the vent to an extent that the flapper valve may not be necessary. Of course, in colder climates where there is a concern about loss of heat, the flapper valve is still desirable.

It will also be noted that the front piece 168 is essentially replaceable, if damaged or the like. To install a front piece, the upper edge 180 is placed in slot 182 formed on the underside of the top of the vent. Then a stop 132 is rotated through the opening until lower front wall 156 rides up and over a cam stop 184. The lower front wall 156 is retained between cam stop 184 and a stop ridge 186. This easy snap fit engagement provides for a secure, yet easily replaceable grill.

From FIGS. 4 and 5 it is apparent that an overhang 120 of the present invention according to the second embodiment differs from the overhang 20. The overhang 120 extends forward of the open front 118 and down towards the peripheral flange 112, while the overhang 20 extends forward to a much lesser extent and does not extend down at all. The more pronounced overhang 120 renders the water directing means less necessary and, accordingly, neither the directing rib 30 nor the projecting rib 31 have corresponding elements on the second embodiment of the present invention. The overhang 120 preferably extends sufficiently to prevent rain water from directly impinging on the grill 22.

It is believed that the overhang 120 also contributes to preventing unnecessary opening and closing of the flapper valve, in the absence of internal pressure (i.e. by a fan or the like). Under some wind conditions, a negative pressure may be created in front of the vent, and a larger overhang contributes to preventing such a low pressure from being direct enough on the flapper valve to cause it to unseat.

An alternative to using the stop 132 as a resting point for the flapper valve 126, a pivot stop may be molded into the vent cover behind the pivot hinge, as shown at 190. This pivot stop will preferably be engaged just before, or just as the flapper valve touches the lip 132, and will prevent the flapper valve from banging down onto the lip. To make use of the pivot stop 190, requires the flapper valve extend beyond the pivot axis, as shown at 192.

Although the present invention has been described with reference to preferred examples thereof, it will be appreciated by those skilled in the art that various alterations and modifications can be carried out without departing from the scope of the invention. For example, the following arrangement may be substituted for hinge 140. A pivoting engagement may be formed by a bore and shaft arrangement where the bores are part of the continuous hollow body 114 and the shafts project out in opposite direction from the opposite corners of the fixed end 142 from the flapper valve 126. When the shafts are snapped into the corresponding bores, the fixed end 142 of the flapper valve 126 is attached to the continuous hollow body 114, but the flapper valve 126 may rotate around the axis substantially defined by fixed end of the flapper valve 126 and the centre-line of the shaft and bore arrangement.

I claim:

1. An exhaust vent cover comprising:

a peripheral flange for attaching the cover to a surface;

a hollow body extending upwardly from the flange and having an air passageway communicating with an open front, said body including an overhang extending beyond said open front;

a replaceable grill covering said open front, said grill including a plurality of water inhibiting fins, which inhibit water from entering the open front;

a flapper valve across said air passageway, said flapper valve being pivotally attached to said body closely adjacent one end of said flapper valve wherein, in response to a greater air pressure below said flapper valve, an end of said flapper valve distant from said pivotal attachment pivots upwardly to allow air to pass past said flapper valve and out of said open front, said flapper valve including an air deflection surface, facing towards said open front, to inhibit unwanted opening of said flapper valve;

said peripheral flange further including a plurality of attachment openings wherein each of said attachment openings is in the form of a slot, said slots having a longer axis and a shorter axis wherein the longer axis is oriented toward the center of the body to allow the body to expand and contract, to facilitate attachment of the vent cover to an underlying surface.

2. An exhaust vent cover as claimed in claim 1 wherein said water inhibiting fins extend laterally across said opening, and have a depth and thickness, wherein said depth is greater than said thickness.

3. An exhaust vent cover as claimed in claim 2 wherein said depth of said fins varies from fin to fin, with the lowermost fins being of a more narrow depth, while the uppermost fins are of a greater depth.

4. An exhaust vent cover as claimed in claim 3 wherein said replaceable grill is separately molded from said body and can be inserted from a front of said body through said opening.

5. An exhaust vent as claimed in claim 1 wherein said body includes a pivot stop, and said flapper valve includes an extension, beyond said pivotal attachment, said extension engaging said pivot stop to define a rest position for said flapper valve.

6. An exhaust vent cover as claimed in claim 1 wherein the body is integrally formed from plastic.

7. An exhaust vent cover as claimed in claim 1 wherein said cover is injection molded from talc filled polypropylene.

8. An exhaust vent cover as claimed in claim 1 wherein said hollow body has an outer surface which includes means for directing water away from said open front.

9. An exhaust vent cover as claimed in claim 2 wherein said means for directing water comprises an upwardly projecting lip on said overhang to direct water away from said open front.

10. An exhaust vent cover as claimed in claim 2 wherein said means for directing water comprises at least one water directing rib above said overhang to direct water away from said overhang and away from said open front.

11. An exhaust vent cover as claimed in claim 1 wherein said valve is a flapper valve pivotally mounted at one end and resting on a pivot stop at the other end, and in response to a greater air pressure below than above, said flapper valve pivots upwardly to allow pressure equalization to occur.

12. An exhaust vent cover as claimed in claim 11 wherein said grill is comprised of a plurality of vertical ribs, and said stop for said flapper valve comprises a lip below said grill.

13. An exhaust vent cover as claimed in claim 12 wherein said flapper valve includes at least one tooth at said free end, wherein said at least one tooth rests on said stop.

14. An exhaust vent cover as claimed in claim 13 wherein said flapper valve toothed edge of said free end fits between said plurality of vertical ribs of said grill.

* * * * *